US010279450B2

(12) United States Patent
Lutz et al.

(10) Patent No.: US 10,279,450 B2
(45) Date of Patent: May 7, 2019

(54) HAND-HELD POWER TOOL WITH A COOLING UNIT

(71) Applicant: Robert Bosch GmbH, Stuttgart (DE)

(72) Inventors: Manfred Lutz, Filderstadt (DE); Peter Stierle, Pliezhausen (DE)

(73) Assignee: Robert Bosch GmbH, Stuttgart (DE)

( * ) Notice: Subject to any disclaimer, the term of this patent is extended or adjusted under 35 U.S.C. 154(b) by 34 days.

(21) Appl. No.: 15/617,879

(22) Filed: Jun. 8, 2017

(65) Prior Publication Data

US 2017/0361416 A1 Dec. 21, 2017

(30) Foreign Application Priority Data

Jun. 17, 2016 (DE) ..... 10 2016 210 853

(51) Int. Cl.
*B24B 23/02* (2006.01)
*B24B 23/00* (2006.01)
*B24B 55/03* (2006.01)

(52) U.S. Cl.
CPC ..... *B24B 23/028* (2013.01); *B24B 23/005* (2013.01); *B24B 55/03* (2013.01)

(58) Field of Classification Search
CPC ..... B24B 23/02; B24B 23/04
USPC ..... 451/449, 359, 344, 53
See application file for complete search history.

(56) References Cited

U.S. PATENT DOCUMENTS 7,597,157 B2 * 10/2009 Stierle ..... B24B 23/028 173/171
8,113,922 B2 * 2/2012 Esenwein ..... B24B 23/028 310/47
2012/0184191 A1 * 7/2012 Schulze ..... B24B 23/02 451/449

FOREIGN PATENT DOCUMENTS

DE 103 47 943 A1 5/2005

* cited by examiner

*Primary Examiner* — Robert Rose
(74) *Attorney, Agent, or Firm* — Maginot, Moore & Beck LLP

(57) ABSTRACT

A hand-held power tool includes a housing, a motor, a cooling unit, and a plurality of electronics. The housing includes a first housing part and an air intake opening. The motor is assigned to a drive train of the hand-held power tool. The cooling unit is configured to cool the motor. The plurality of electronics is located in the housing. The first housing part includes at least one air channel that is integral with the first housing part. The air intake opening is configured to conduct a cooling air flow directly to the motor via the at least one air channel.

13 Claims, 12 Drawing Sheets

HAND-HELD POWER TOOL WITH A COOLING UNIT

This application claims priority under 35 U.S.C. § 119 to patent application no. DE 10 2016 210 853.0, filed on Jun. 17, 2016 in Germany, the disclosure of which is incorporated herein by reference in its entirety.

The disclosure relates to a hand-held power tool with a cooling unit.

BACKGROUND

Compact, high-performance hand-held power tools require optimum cooling of typical heat sources, such as the motor or the electronics, for maximum performance.

The cooling of the hand-held power tool is realized, as a rule, by means of a fan which sits on the motor shaft and sucks cooling air into the housing of the hand-held power tool via air intake openings. In this case, the cooling air is run in as direct a manner as possible past all components which provide the heat sources.

As hand-held power tools are frequently used in rough environments, it is possible that the cooling air may be contaminated with different metal particles, such as, for example, mineral or metallic dusts and fibers. Said particles are sucked in with the cooling air, as a result of which the particles may be deposited in the hand-held power tool, which, in turn, can result in impairment of the hand-held power tool.

DE 10 347 943 A1, as an example, describes a hand-held power tool which comprises a cooling device which comprises, at least in portions thereof, a cooling channel which is closed substantially in relation to an interior of the housing.

SUMMARY

The object to provide a hand-held power tool which comprises a particularly efficient cooling unit is produced from the prior art.

The disclosure proceeds from a hand-held power tool, in particular an angle-grinding machine, including a housing, wherein a motor which is assigned to the drive train of the hand-held power tool, a cooling unit which is realized for the purpose of cooling the motor, and electronics are arranged in the housing, wherein a first housing part of the housing, in particular a motor housing, of the hand-held power tool comprises at least one air channel. It is proposed that the air channel is realized integrally with the first housing part, wherein a cooling air flow is conductible from an air intake opening of the housing directly to the motor via the air channel.

In an advantageous manner, the cooling air necessary for cooling the motor can be run past upstream components via the at least one air channel such that turbulence in the cooling air is prevented. The turbulence would otherwise result in dust being deposited, culminating in the free airflow cross sections necessary for the cooling being blocked and consequently preventing the motor cooling and possibly the cooling of other components.

The hand-held power tool is, in particular, a portable hand-held power tool which is able to be transported by an operator. The hand-held power tool comprises, in particular, a weight which is less than 40 kg, in a preferred manner less than 10 kg and in a particularly preferred manner less than 7 kg. The hand-held power tool is realized in a particularly preferred manner as an angle-grinding machine. However, it is also conceivable for the hand-held power tool to comprise a different design which appears sensible to the person skilled in the art, such as, for example, a design as a hammer drill and/or chisel hammer, as a drill, as a reciprocating saw, as a jigsaw, as a hedge trimmer, etc.

The housing of the hand-held power tool can be a single-part or multi-part housing which is realized for the purpose of receiving components of the hand-held power tool, such as, for example, a motor, in particular an electric motor, a transmission, the electronics, etc. In particular, the housing of the hand-held power tool is an exterior housing, the exterior housing also being able to include housing parts which are arranged in the interior of the housing. In an advantageous manner, the housing includes at least one housing part which can be designed in a pot-like manner or rather in the manner of a hollow cylinder or with the housing in the manner of a half shell. In an advantageous manner, the housing of the hand-held power tool comprises at least one motor housing in which the motor is arranged, and one handle housing. The handle housing can be realized in a stem-shaped manner, gun-shaped manner or pot-shaped manner. The handle housing is provided, in particular, for the purpose of providing on its outside surface a handle region which is realized so that the hand-held power tool is able to be held by a user.

The motor of the hand-held power tool can be realized as an electronically commutated electric motor and is provided for the purpose of driving an insertion tool. The commutation is effected in the case of electronically commutated electric motors by means of electronics. As an alternative to this, it is also conceivable for the hand-held power tool to comprise an electric brush motor where the commutation of the motor is realized via carbon brushes.

In an advantageous manner, the cooling unit comprises a fan element which is realized for the purpose of generating a cooling air flow. The fan element generates negative pressure in the housing of the hand-held power tool, as a result of which air is able to be sucked into the housing of the hand-held power tool via at least one air intake opening of the housing of the hand-held power tool. In an advantageous manner, the fan element is situated in the direction of flow of the cooling air flow downstream of the motor of the hand-held power tool. As an alternative to this, it is also conceivable for the fan element to be situated upstream of the motor in the direction of flow.

The electronics of the hand-held power tool can comprise a switching element, a mains connection, cabling, plugs and/or an actuator. The switching element is realized, in particular, for the purpose of switching the hand-held power tool on and off. The mains connection is realized for the purpose of supplying the hand-held power tool with power. The actuator can be realized as a component which is actuatable by the operator of the hand-held power tool. In particular, the actuator is mounted on the hand-held power tool so as to be movable. The actuator is realized for the purpose of adjusting at least one operating function, such as, for example, the rotational speed of the insertion tool.

An air channel which is realized integrally with a housing part is to be understood, in particular, as an air channel which is realized with a housing part as a component. In an advantageous manner, a cooling air flow is conductible directly to the motor in such a manner from an air intake opening of the housing of the hand-held power tool that the first component of the hand-held power tool which is acted upon inside the housing by the cooling air flow is the motor. In particular, the first component of the hand-held power tool which is cooled by the cooling air flow is the motor. In a particularly advantageous manner, no turbulence elements are arranged along the air channel. A turbulence element is to be understood, in this case, in particular, as a component of the hand-held power tool or a structural element of the housing of the hand-held power tool which results in turbulence of the cooling air flow.

The air channel can be realized in a closed manner with an air inlet opening and an air outlet opening. A closed air channel is to be understood, in particular, as the air channel comprising a wall which is substantially closed. The air channel is surrounded, in particular, on all sides. The air channel can comprise, for example, four side walls and a substantially rectangular cross section. However, a different geometric design of the cross section such as, for example, a round one is also conceivable. In particular, a side wall of the air channel can also be realized at least in part as an exterior wall of the housing. A closed wall is realized, in this case, without a gap in the circumferential direction between the air inlet opening and the air outlet opening. A substantially closed wall can comprise, in portions along the longitudinal extension of the air channel, a gap which is caused, for example, by a material transition. In an advantageous manner, up to 50% of the wall, in a particularly advantageous manner up to 75% or up to 100% is realized in a closed manner. The closed cooling channel is realized advantageously without turbulence elements and without gaps at which deposits are able to be formed.

At least one second housing part of the housing, in particular a housing cover, can comprise a second air channel, wherein at least one air channel of the first housing part, one air channel of the second housing part and a further air channel of the first housing part are arranged in the circumferential direction of the hand-held power tool. Efficient motor cooling can be realized in an advantageous manner as a result of a plurality of cooling channels.

The air channels of the first and of the second housing part can be arranged in such a manner that an anti-rotation device of the housing parts with respect to one another is provided. The anti-rotation device can act, in this case, in one direction of rotation, advantageously in both directions of rotation. In particular, at least one air channel of the first housing part acts upon at least one air channel of the second housing part in such a manner that a rotation of the second housing part is blocked at least in part in the circumferential direction. This can be realized, for example, as a result of the wall of an air channel of the first housing part abutting against the wall of an air channel of the second housing part. In particular, the walls abut against one another substantially along their longitudinal extension. It is also conceivable for the wall of the air channel to comprise outwardly protruding projections which act upon the wall of a further air channel. The rigidity of the housing of the hand-held power tool is significantly increased in an advantageous manner as a result of said design.

One housing part can be realized as a socketed cover, wherein the socketed cover comprises, in particular, at least one air channel. The socketed cover is advantageously arranged on a housing-side end of the hand-held power tool and is realized for the purpose of fastening a cable support sleeve on the hand-held power tool. A mains cable for the power supply of the hand-held power tool can be run via the cable support sleeve into the interior of the housing of the hand-held power tool. The socketed cover can additionally comprise an additional air intake opening which is provided for cooling the electronics. So that the housing of the hand-held power tool comprises sufficient air inlets, the socketed cover can be realized in a correspondingly large manner and can replace part regions of the housing cover. It is also conceivable for the socketed cover to consist of two or more housing parts.

The air intake openings can be arranged on an end-face end and/or on the side of the housing of the hand-held power tool. In particular, the end-face end is arranged on the rear end region of the hand-held power tool, the mains connection or a rechargeable battery interface being arranged on the rear end region of the hand-held power tool. In an advantageous manner, the air intake openings are arranged on the side of the housing on the rear end region of the hand-held power tool. In an advantageous manner, arranging the air intake openings on an end-face end and/or on the side of the housing of the hand-held power tool ensures that the operator of the hand-held power tool does not cover the air intake openings during use.

As an alternative to this, it is also conceivable for the end-side end to be arranged on a front end region of the hand-held power tool. In particular, the air intake openings can also be arranged on a gear head of an angle-grinding machine.

The air channel can comprise a recess, wherein a cooling body of the electronics is arranged in such a manner in the recess that the cooling body of the electronics forms at least in part at least one wall of the air channel. The cooling body of the electronics is realized, in particular, for the purpose of cooling the electronics. In an advantageous manner, the cooling body is arranged in such a manner in the recess of the air channel that it replaces the wall of the air channel in the recess. As a result, cooling of the electronics can be achieved in an advantageous manner without any significant reduction in the performance of the cooling of the motor.

The air channel can be realized at least in portions along the direction of flow of the cooling air as a cooling body of the electronics. In particular, the wall of the air channel is interrupted along the longitudinal extension, the wall of the cooling channel being replaced by the cooling body in the interruption in such a manner that the cooling body replaces the wall of the air channel along the entire circumferential direction. Advantageously, a particularly high performance of the cooling of the electronics can be realized as a result.

The electronics can be arranged on a carrier component, wherein the carrier component comprises at least one air channel. The carrier component can be produced, as an example, from a plastics material and can be realized so as to be pluggable onto a housing part.

The carrier component can be realized as a cooling body, in particular produced from a heat-conducting material, in an advantageous manner from a heat-conducting plastics material. As a result of said measure, the cooling air can be conducted directly to the motor in an advantageous manner without generating turbulence, the electronics being passively cooled at the same time.

BRIEF DESCRIPTION OF THE DRAWINGS

Further advantages are produced from the following description of the drawings. Exemplary embodiments of the disclosure are shown in the drawings. The drawing, the description and the claims include numerous features in combination. The person skilled in the art will also look expediently at the features individually and form them into sensible further combinations. The drawings are as follows:

DETAILED DESCRIPTION

Figure 1A:
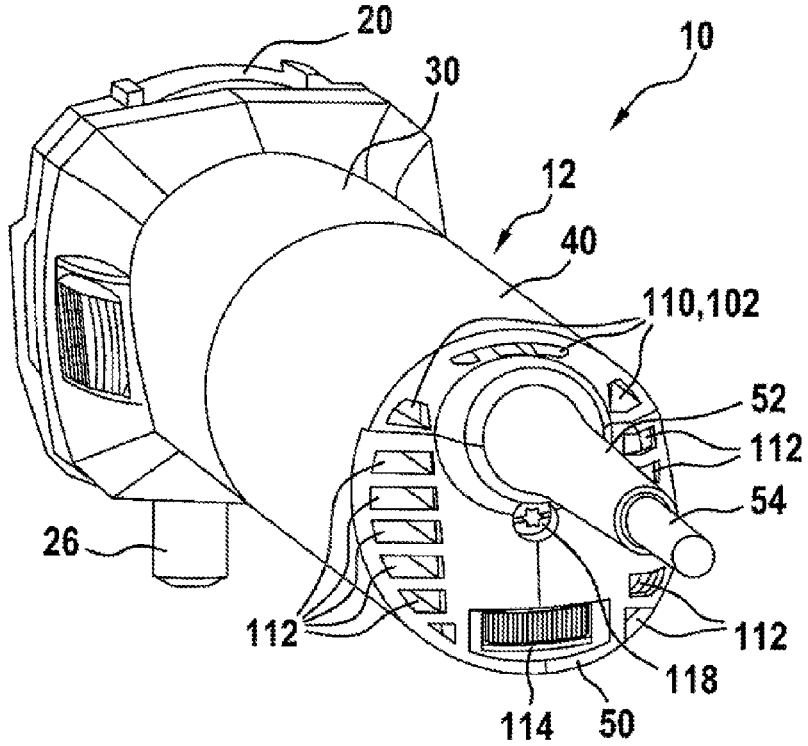
FIG. 1*a*: shows a perspective view of a hand-held power tool with air channels.
Figure 1B:
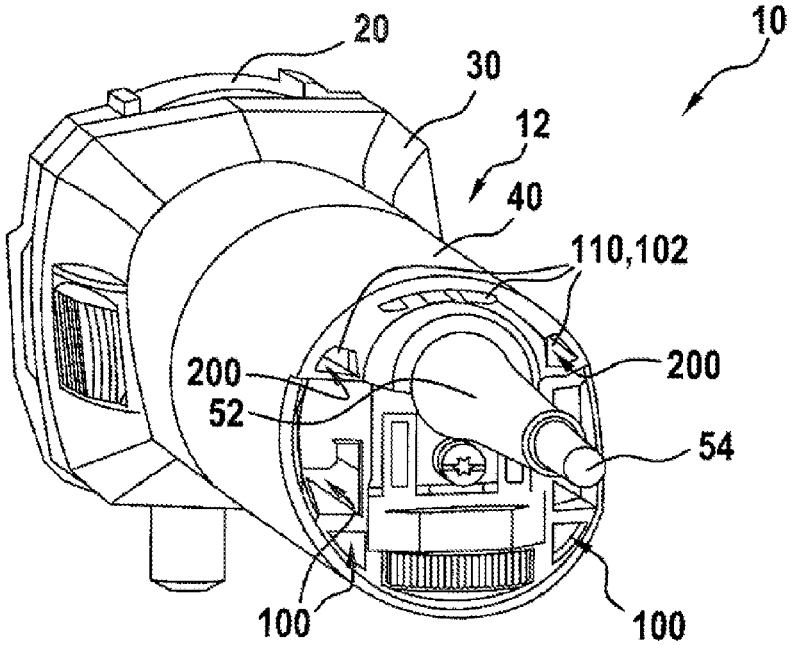
FIG. 1*b*: shows a perspective view of a hand-held power tool according to FIG. 1*a* without a socketed cover.
Figure 1C:
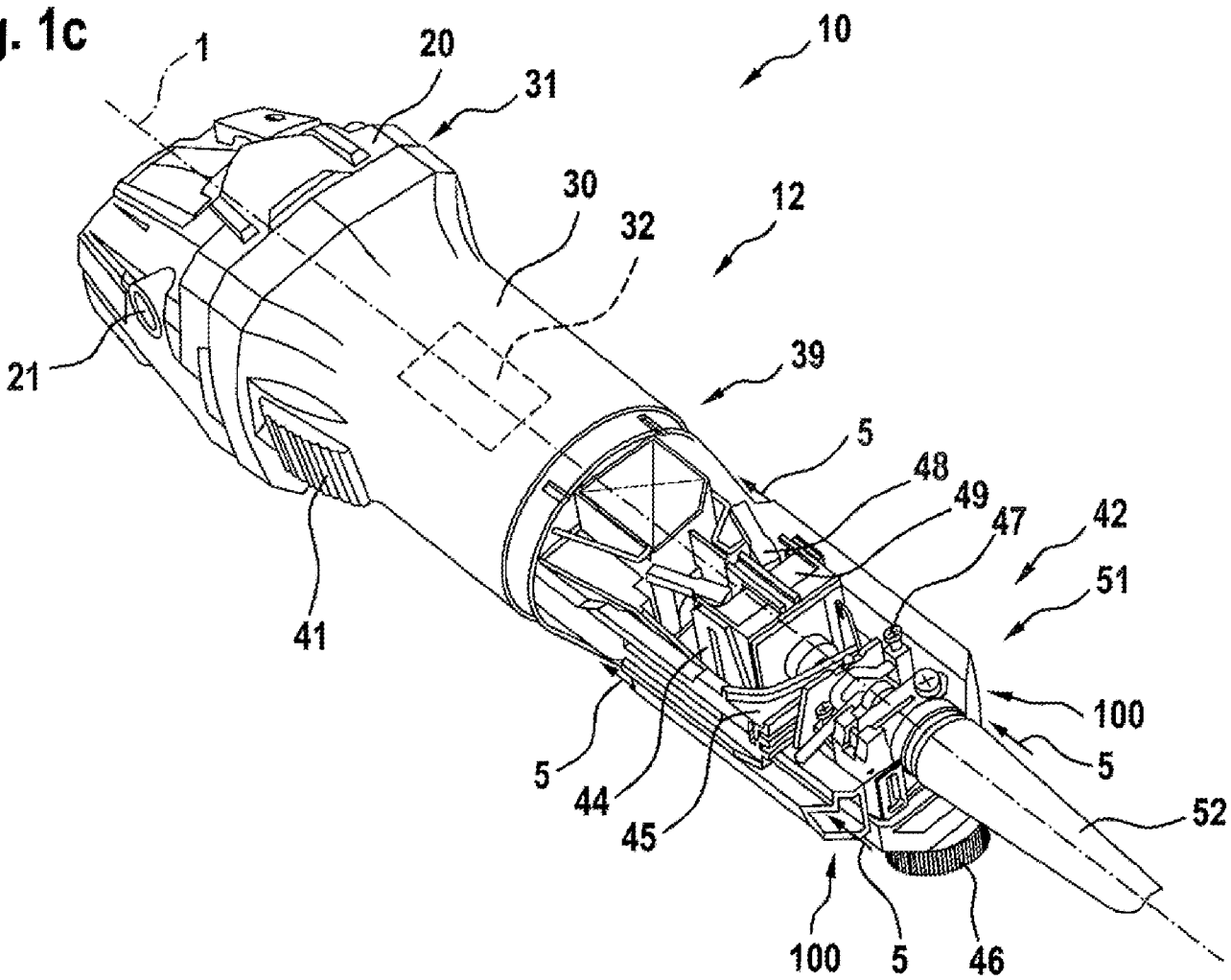
FIG. 1*c*: shows a perspective view of a hand-held power tool according to FIG. 1*b* without a handle housing.
Figure 1D:
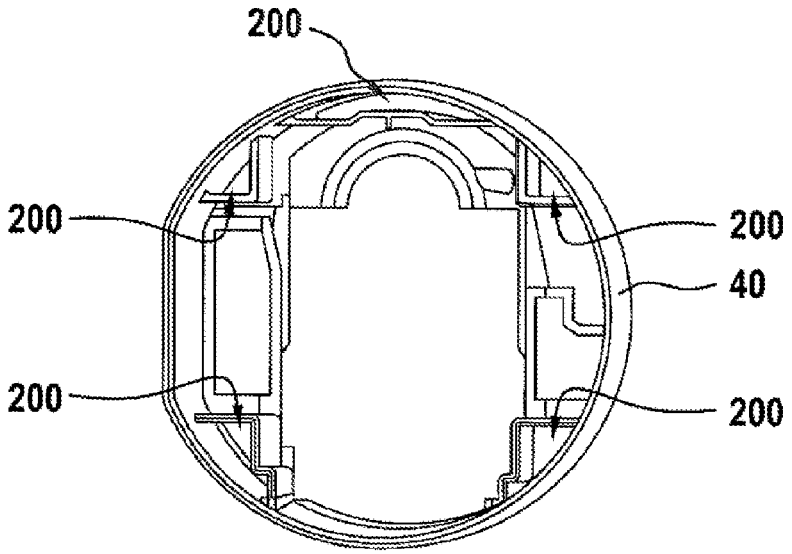
FIG. 1*d*: shows a perspective part view of the handle housing of the hand-held power tool according to FIG. 1*a*, FIG. 1*e*: shows a further perspective part view of the handle housing of the hand-held power tool according to FIG. 1*a*, FIG. 1*f*: shows a cross section through the air channels of the hand-held power tool according to FIGS. 1*a*-1*e*, FIG. 2*a*: shows a perspective view of a socketed cover with air channels.
Figure 1E:
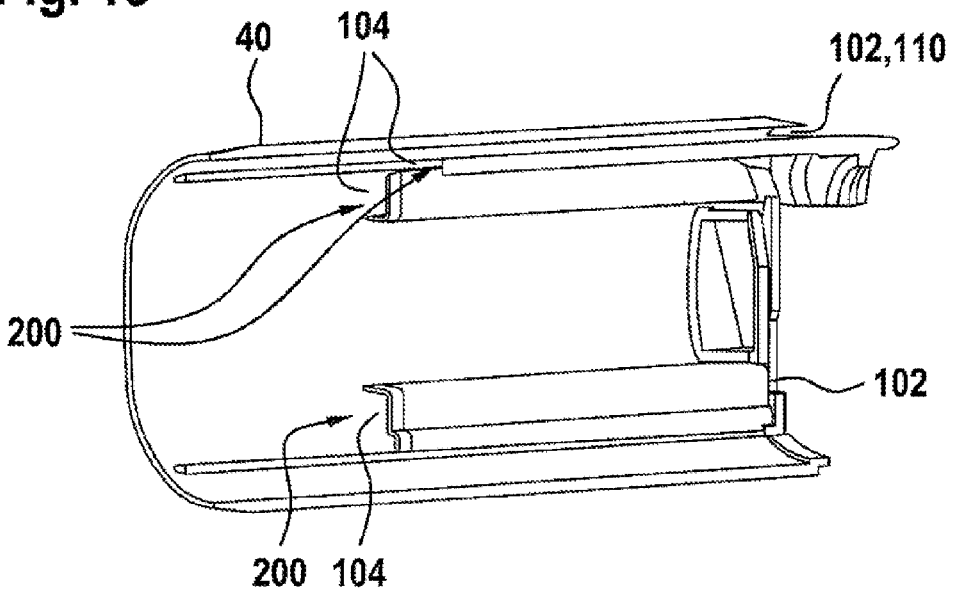

FIGS. 1*a* to 1*e* show a perspective view of a hand-held power tool 10 with air channels 100, 200. FIG. 1*b* shows a perspective view of a hand-held power tool 10 according to FIG. 1*a* without a socketed cover 50 and FIG. 1*c* shows a perspective view of a hand-held power tool 10 according to FIG. 1*b* without a handle housing 40. The hand-held power tool 10 is realized, as an example, as an angle-grinding machine. The hand-held power tool 10 comprises a housing 12 which includes a gear head 20, a motor housing 30, a handle housing 40 and a socketed cover 50. The gear head 20 can be produced from a metal and is fastened on the motor housing 30 by way of screws. An additional handle is mountable, as an example, on the gear head 20 by means of a receiving means 21. A receiving flange (not shown), on which a protective cover is rotatably fastenable, is arranged on the bottom surface of the gear head 20. The receiving flange comprises a central opening, through which an output spindle 26 is guided. The output spindle 26 is realized so as to be rotatably connectable or rather couplable to or with an insertion tool (not shown) of the hand-held power tool 10, for example a cutting disk.

The motor housing 30 includes, as an example, two portions. The first portion of the motor housing 30 is realized in the manner of a hollow cylinder. In particular, an electric motor 32 is arranged in the first portion of the motor housing 30. The first portion of the motor housing 30 is loosely connected to the gear head 20 on a first connecting region 31. A fan element (not shown), which is realized for the purpose of generating a cooling air flow 5 for cooling the electric motor 32, is arranged on the motor-housing-side in the first connecting region 31 of the motor housing 30. The electric motor 32 includes a motor shaft which is coupled with the output spindle 26 by means of a crown wheel. The motor shaft extends along the axial axis 1 of the hand-held power tool 10. In particular, the rotational axis of the motor shaft corresponds to the axial axis 1 of the hand-held power tool 10. In the second connecting region 39 of the motor housing 30, the outside contour of the motor housing 30 merges into the outside contour of the handle housing 40. The handle housing 40 is realized in a pot-shaped manner. The handle housing 40 comprises air intake openings 110, through which the cooling air is able to enter into the housing 12 of the hand-held power tool 10, on the end-face end of the hand-held power tool 10. Another socketed cover 50, which comprises air intake openings 112, 114 and a screw receiving opening 116, is arranged in addition on the end-face end of the hand-held power tool 10. The handle housing 40 can be slid open by means of the second portion of the motor housing 30. The socketed cover 50 is fitted onto the handle housing 40. The handle housing 40 is connected to the motor housing 30 and to the socketed cover 50 by means of a screw 118, the counter thread for the screw 118 being arranged in the motor housing 30. In the connected state, a cable support sleeve 52, which is realized for the purpose of conducting a mains cable 54 into the hand-held power tool, is mounted between the handle housing 40 and the socketed cover 50. The second portion of the motor housing 30 is realized as a continuation which is encased by the handle housing 40. The second portion of the motor housing 30 is provided for the bearing arrangement or receiving of hand-held power tool components, in particular, the electronics 42. The electronics 42 include, as an example, a setting wheel 46 which is provided for adjusting the speed of the insertion tool, at least one electric contact element 48 which is provided for the electric connection between a switching element 49 and the drive train of the hand-held power tool 10, a shift linkage 45, a push button of the switching element 49 being actuatable via the shift linkage 45 when the operating switch 41 is actuated, and at least one mains connection 47 which is realized for the purpose of connecting the mains cable 54 to the electronics 42 in an electrical manner. The electronics 42 are arranged at least in part in a carrier component 44 which is realized so as to be detachably fastenable on the motor housing 30.

The hand-held power tool 10 is shown in the form of a mains-operated hand-held power tool which comprises the mains cable 54 for the power supply on the rear end 51 of the hand-held power tool 10. However, it is also conceivable for the power supply to be realized by means of a rechargeable battery pack, the rechargeable battery pack being connectable mechanically and electrically to the hand-held power tool via a rechargeable battery pack interface. A rechargeable battery pack is to be understood, in this case, as one or several battery cells which are connected together and are arranged in a housing. The housing of the rechargeable battery pack, in this case, comprises a rechargeable battery pack interface on its outside surface.

The air intakes 110, 112, 114 of the hand-held power tool 10 are distributed, as an example, over two housing parts 40, 50. The air intakes 110, which are arranged, in particular, in the vicinity of the socket receiving means, are realized, as an example, as air inlet openings 102 of the air channels 200 of the handle housing 40. In an advantageous manner, the cooling air flow 5 can be conducted directly into an air channel 200. The handle housing 40 and the air channel 200 which are assigned to the handle housing 40 are shown in perspective in FIG. 1*d* and FIG. 1*e*. The air channels 200 are realized in a closed and integral manner with the handle housing 40. The cooling air flow 5 enters into the air channel 200 via air inlet openings 102 and leaves the air channel 200 via air outlet openings 104. The air outlet openings 104 are advantageously arranged in such a manner that the cooling air flow 5 is conducted directly to the motor without the cooling air flow 5 acting upon essential components of the electronics 42, such as the switching element 49 or the mains connection 47. In addition, the cooling air flow 5 can also enter into the hand-held power tool 10 through air intake openings 112 which are assigned, as an example, to the socketed cover 50 and is then conducted to air inlet openings 102 of the air channel 200. The cooling air flow 5 is conducted via the air intake openings 112 to air inlet openings 102 of air channels 100, 200 which are assigned both to the handle housing 40 and to the motor housing 30 (can be seen in FIG. 1*c*). FIG. 1*c* also shows that the air channels 100, 200 extend substantially parallel to the axial axis 1 of the hand-held power tool 10 and in a substantially linear manner.

Figure 1F:
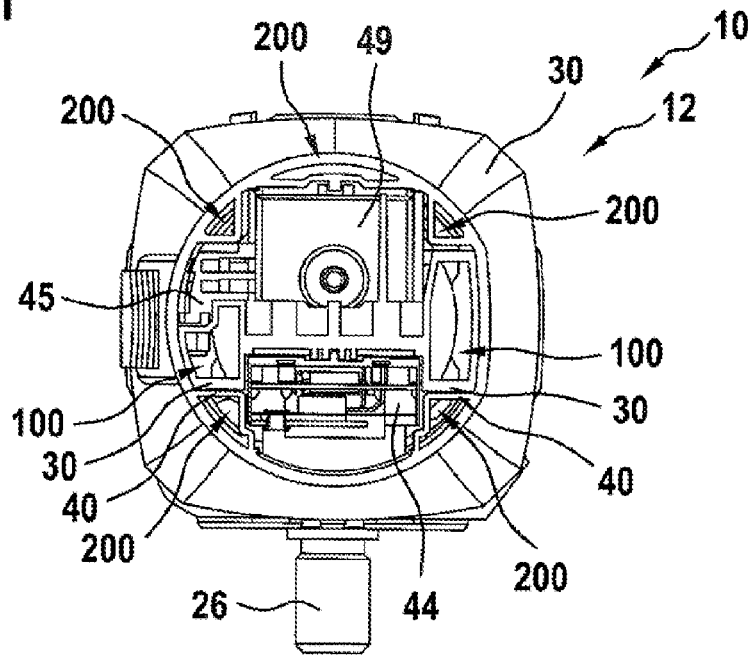

FIG. 1*f* shows a cross section through the air channels 100, 200 of the hand-held power tool 10 according to FIGS. 1*a*-1*e*. The housing 12 of the hand-held power tool 10 comprises a total of seven air channels 100, 200 which are arranged in the circumferential direction of the hand-held power tool 10 in such a manner that the cooling air is conducted past the side of components of the electronics 42 such as, for example, the shift linkage 45, the switching element 49 and the carrier component 44. The air channels 100, 200 of the various housing parts 30, 40 are arranged, in this case, at least in part along the circumferential direction in such a manner that a wall of an air channel 100 of a first housing part abuts against the wall of an air channel 200 of a second housing part and, as a result, the two housing parts 30, 40 are prevented from rotating about the axial axis 1.

Figure 2A:
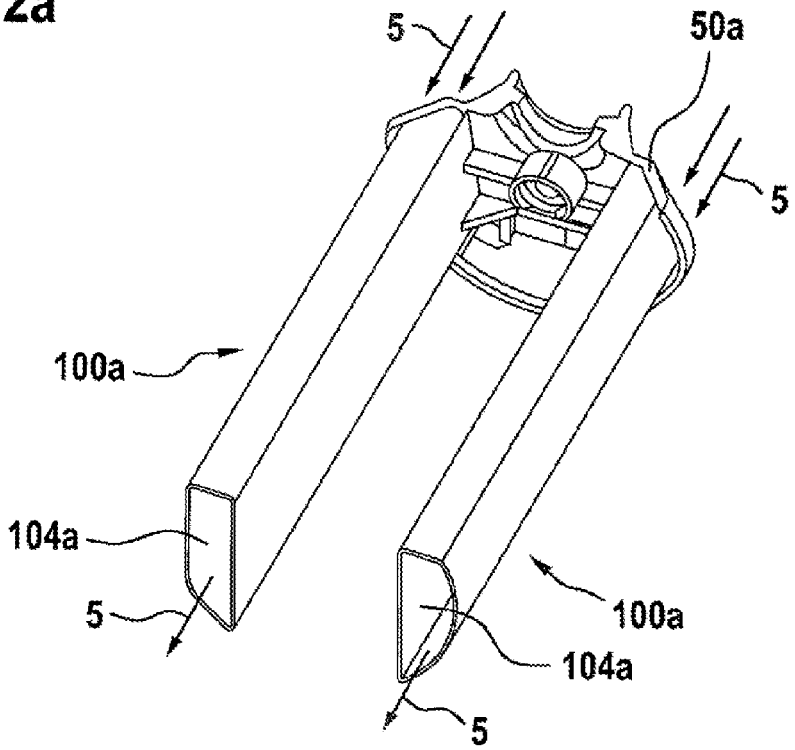
FIG. 2*b*: shows a perspective view of a socketed cover with air channels.
Figure 2B:
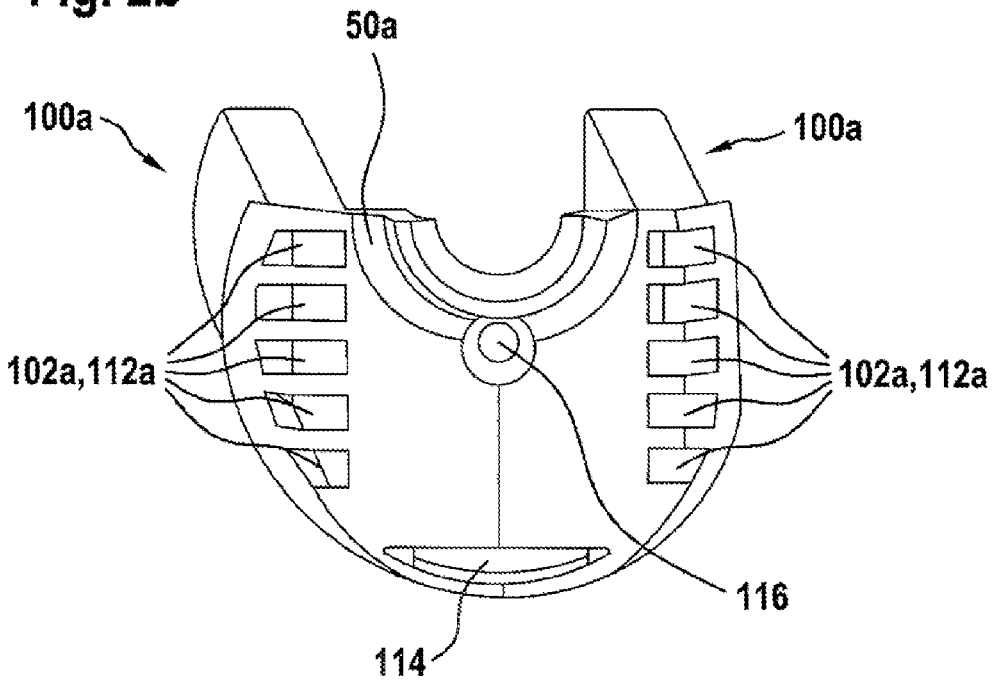

FIG. 2*a* and FIG. 2*b* show a perspective view of an alternative embodiment of the socketed cover 50*a*. The socketed cover 50*a* comprises air intake openings 112*a* which are realized as air inlet openings 102*a* for the air channels 100*a* which are integrally molded on the inside surface of the socketed cover 50*a*. It is conceivable for the air channels 100*a* of the socketed cover 50*a* to replace the air channels 100, 200 of the other housing parts 30, 40 at least in part.

Figure 3:
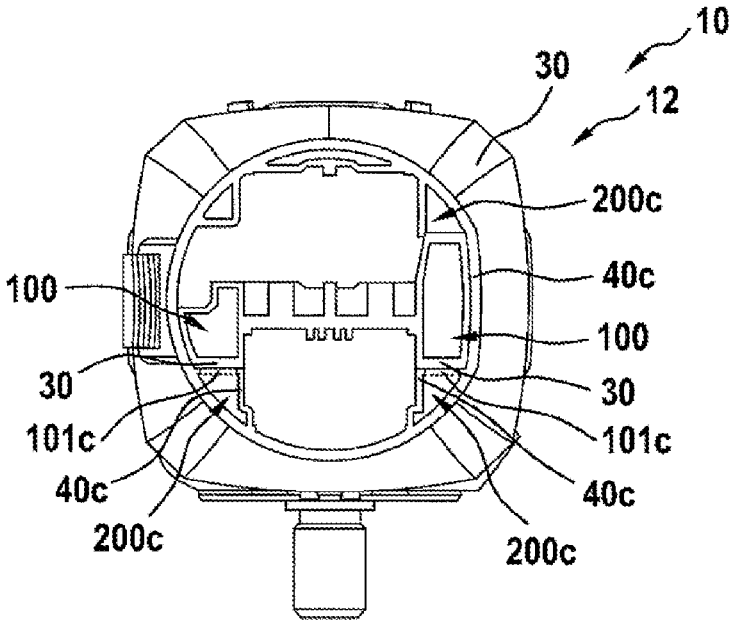
FIG. 3: shows a cross section through a hand-held power tool with an alternative embodiment of air channels.

It is also conceivable, as shown in FIG. 3, for at least one air channel 200*c* not to be realized in an integral manner. It is, for example, conceivable for an air channel 100*c* of the handle housing 40*c* to be realized only closed in part and, in particular, to comprise a recess 101*c* in the wall along the longitudinal extension of the air channel 200*c*. In particular, the wall of an integrally realized air channel 100 is arranged in such a manner in the recess of the partially close air channel 200*c* that the cooling air is not able to leave the partially closed air channel 200*c* via the recess 101*c*. As a result, double walls can be avoided, as a result of which savings in installation space and material costs are able to be made.

Figure 4A:
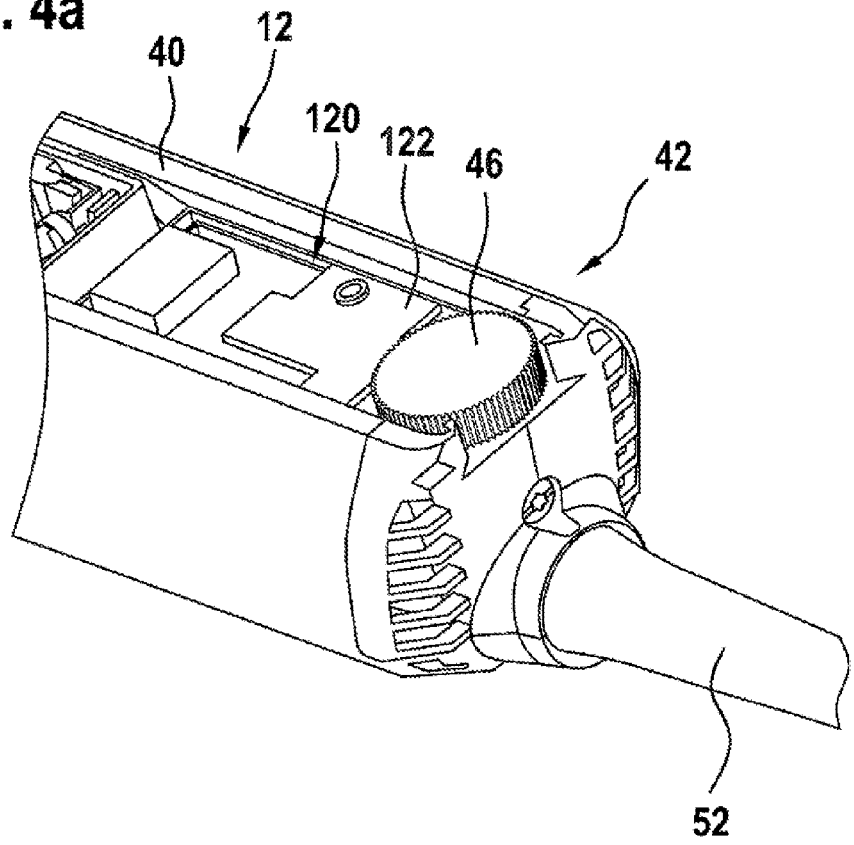
FIG. 4*a*: shows a perspective view of a hand-held power tool.
Figure 4B:
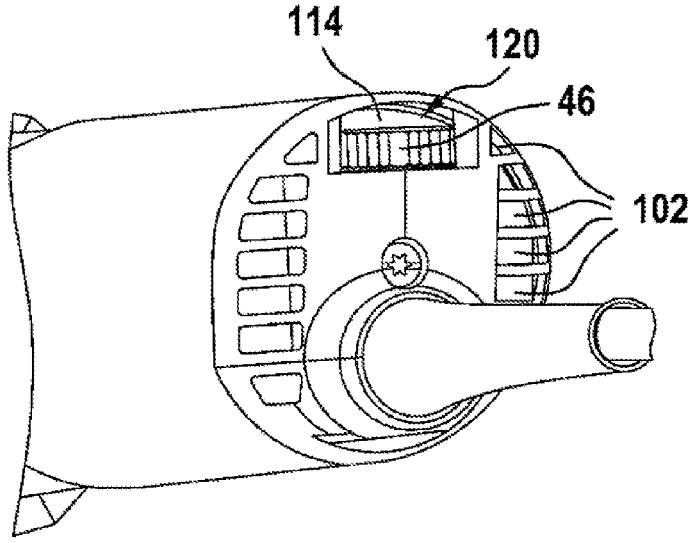
FIG. 4*b*: shows a perspective view of a hand-held power tool.

As shown in FIG. 4*a* and FIG. 4*b* in a perspective view, the hand-held power tool 10 can comprise a separate cooling channel 120 for cooling the electronics 42, which channel extends substantially parallel to the air channels 100. As a result of separating the airflow in the housing 12 of the hand-held power tool 10 into air channels 100 which are provided for cooling the motor and into cooling channels 120 which are provided for cooling the electronics, a particularly efficient distribution of the performance of the cooling inside the hand-held power tool 10 can be realized. The cooling air in the cooling channel 120 acts advantageously upon a cooling body 122 of the electronics 42 which dissipates the waste heat of the electronics 42 in an efficient manner.

Figure 5:
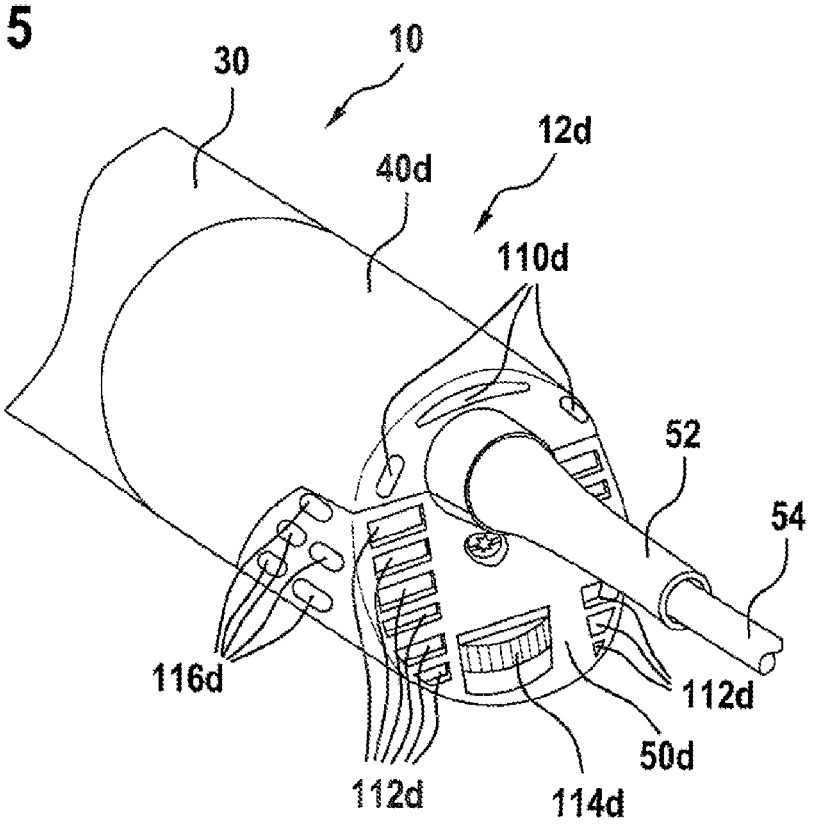
FIG. 5: shows a perspective view of a hand-held power tool with an alternative arrangement of the air intake openings.

FIG. 5 shows a further alternative design of the housing 12*d* of the hand-held power tool 10. The housing 12*d* advantageously comprises lateral air intake openings 116*d* which are connectable to air inlet openings of air channels (not shown). As a result, air intake openings 116*d* can be realized in an advantageous manner laterally or rather transversely with respect to the axial axis 1 of the hand-held power tool 10. As an example, the socketed cover 50*d* is arranged both on the end face of and on the side of the handle housing 40*d* and comprises both end-face air intake openings 112*d*, 114*d* and lateral air intake openings 116*d*.

Figure 6A:
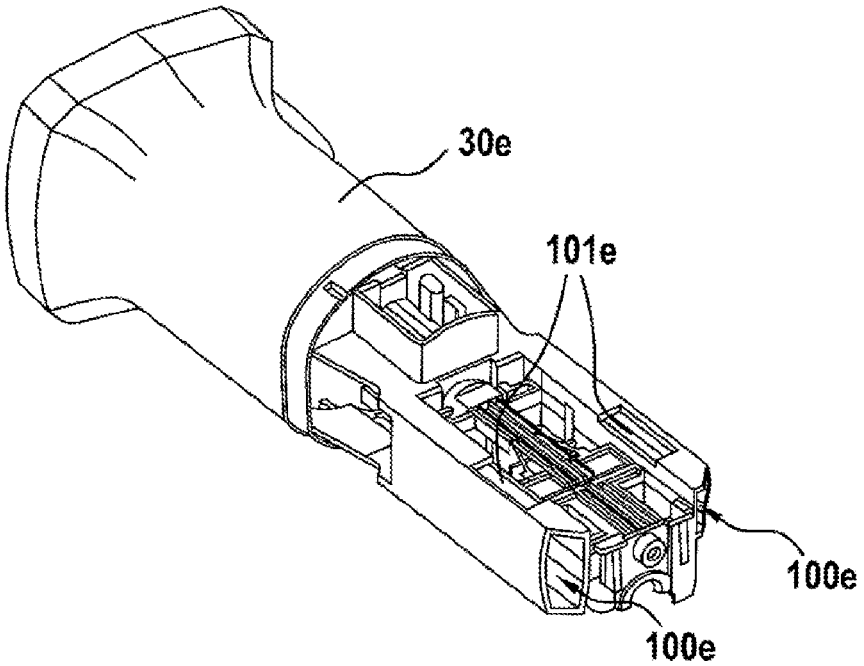
FIG. 6*a*: shows a perspective view of a hand-held power tool with an alternative embodiment of the air channels.
Figure 6B:
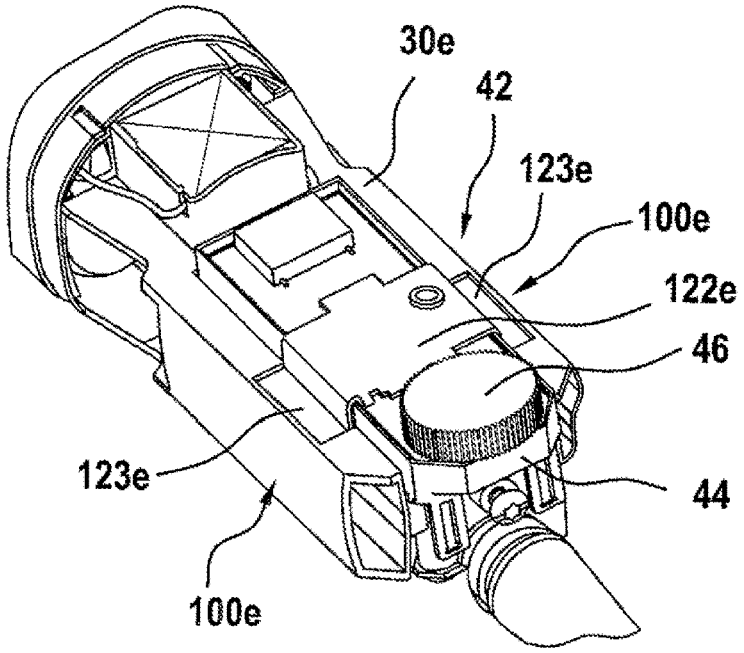
FIG. 6*b*: shows a perspective view of a hand-held power tool with an alternative embodiment of the air channels.

FIG. 6*a* and FIG. 6*b* shows an alternative embodiment of a motor housing 30*e* with closed air channels 100*e*. The air channels 100*e* of the motor housing 30*e* comprise along their longitudinal extension in each case a recess 101*e*, into which the cooling body 122*e* of the electronics 42 can be arranged in part. In particular, two wings 123*e* of the cooling body replace the walls of the air channels 100*e* in the recesses 101*e* in such a manner that the air channel 100*e* continues to be realized in a substantially closed manner apart from the gaps which are to be traced back to the material transitions. The material transition in FIG. 6*a* and FIG. 6*b* is formed, as an example, from a transition from the handle housing 40*e*, which is realized from a hard elastic plastics material, to the cooling body 122*e* which is realized from a metal. In an advantageous manner, efficient passive cooling of the electronics 42 can be realized as a result of the part arrangement of the cooling body 122*e* in the wall of the air channel 100*e*. In an advantageous manner, no separate cooling channel 120 is provided for the electronics 42 in said embodiment, as a result of which the performance of the cooling of the motor is raised. It is consequently conceivable for the electronics 42 to be realized so as to be insulated from the cooling air as a result of the connection between the cooling body 122*e* and the air channels 100*e*.

Figure 7A:
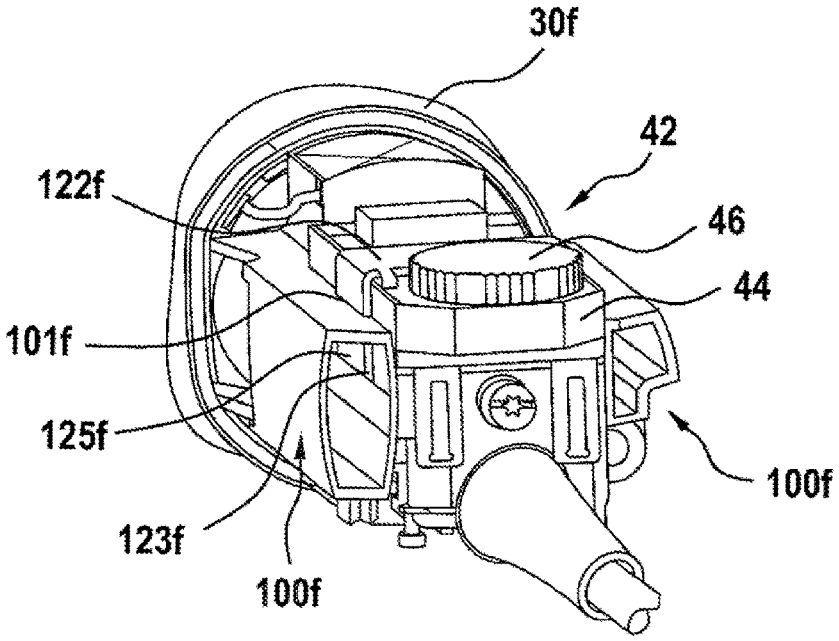
FIG. 7*a*: shows a perspective view of a hand-held power tool with a further alternative embodiment of the air channels.
Figure 7B:
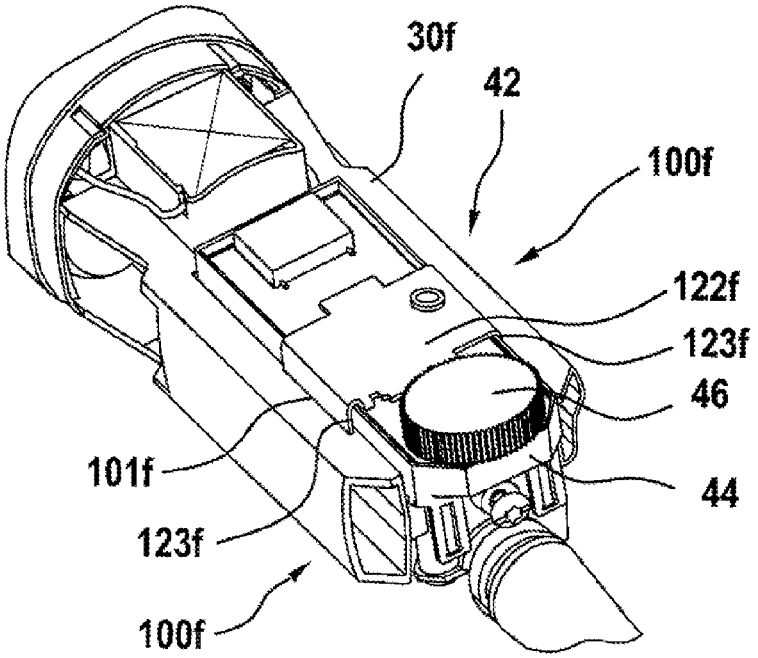
FIG. 7*b*: shows a perspective view of a hand-held power tool with a further alternative embodiment of the air channels.

As an alternative to this, the air channel 100*f* can comprise a recess 101*f*, through which the cooling body 122*f* of the electronics 42 projects at least in part into the air channel 100*f*, as shown in FIG. 7*a* and FIG. 7*b*. In an advantageous manner, a wing 123*f* of the cooling body 122*f* projects in such a manner into the air channel 100*f* that it abuts tightly against the wall of the air channel 100*f*. In particular, the top surface of the side surface 125*f* of the wing 123*f* of the cooling body 122*f* inside the air channel 100*f* extends substantially parallel to the wall of the air channel 100*f* against which the wing 123*f* abuts. In an advantageous manner, as a result of said arrangement the cooling air in the interior of the air channel 100*f* is only swirled minimally by the wing 123*f* of the cooling body 122*f*. In an advantageous manner, in this case, only one side surface 125*f* of the wing 123*f* is acted upon by the cooling air.

Figure 8A:
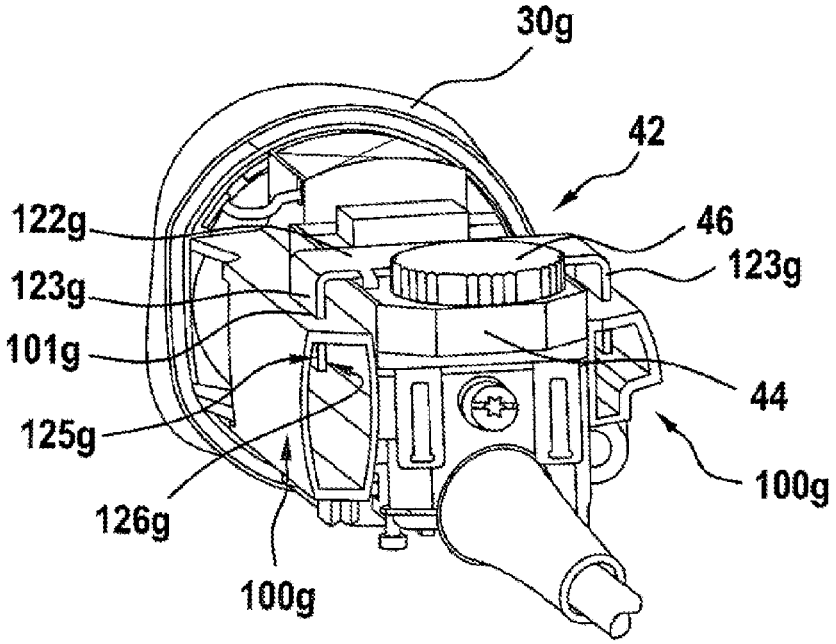
FIG. 8*a*: shows a perspective view of a hand-held power tool with a third alternative embodiment of the air channels.
Figure 8B:
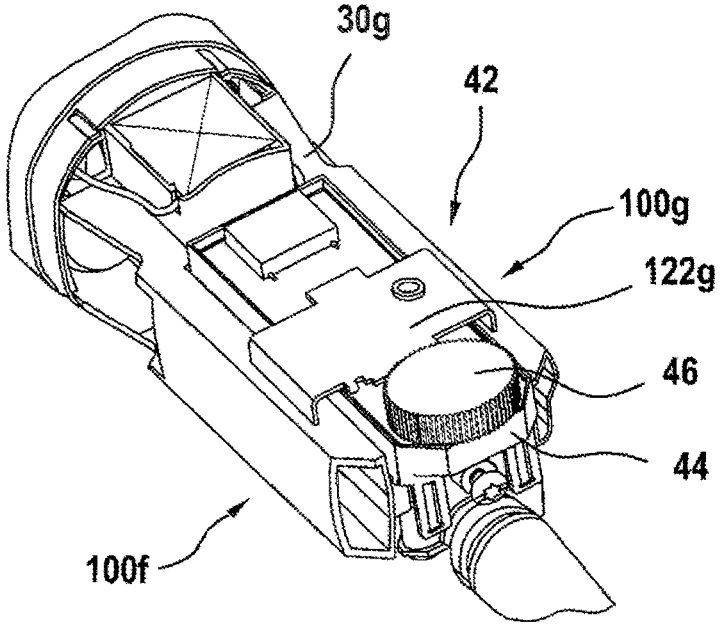
FIG. 8*b*: shows a perspective view of a hand-held power tool with a third alternative embodiment of the air channels.

To increase the performance of the cooling of the electronics, the recess 101*g* can also be arranged in such a manner in the wall of the air channel 100*g* that the wing 123*g* of the cooling body 122*g* projects into the air channel 100*g* at a spacing from the wall of the air channel 100*g*, as shown in FIG. 8*a* and FIG. 8*b*. In an advantageous manner, two oppositely situated side surfaces 125*g*, 126*g* are acted upon by the cooling air as a result. In order to minimize the turbulence occurring as a result, the side surfaces of the wing 123*g* are arranged along the direction of flow of the cooling air.

Figure 9A:
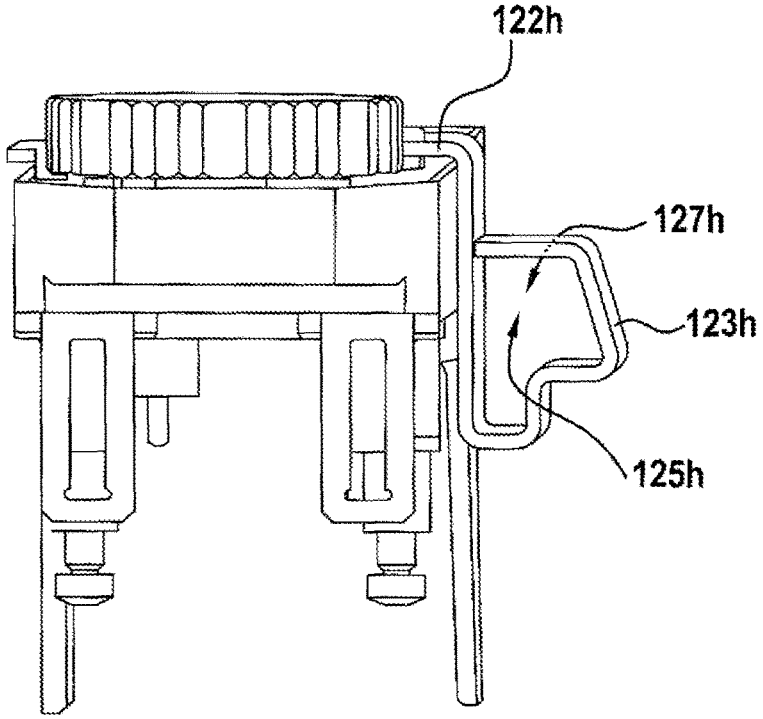
FIG. 9*a*: shows a perspective view of a hand-held power tool with a fourth alternative embodiment of the air channels.
Figure 9B:
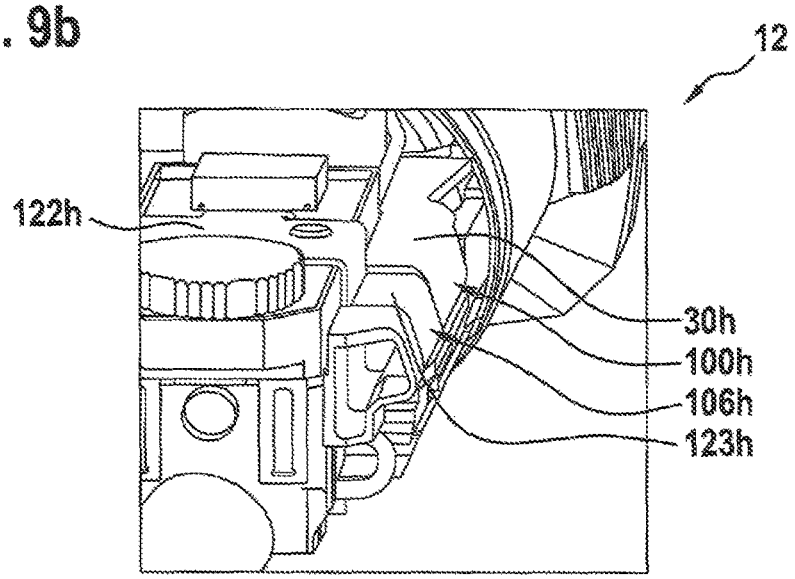
FIG. 9*b*: shows a perspective view of a hand-held power tool with a fourth alternative embodiment of the air channels.

FIG. 9*a* and FIG. 9*b* show a housing 12 with a further alternative embodiment of the air channel 100*h*. The air channel 100*h* is realized integrally with the motor housing 30*h*, in particular in an interrupted manner. A channel-shaped wing 123*h* of the cooling body 122*h* is arranged in the interruption 106*h* of the air channels. In an advantageous manner, the wing 123*h* of the cooling body is formed in such a manner that the wing forms a channel with an inlet opening 125*h* and an outlet opening 127*h*, the cross section of which corresponds substantially to the cross section of the air channel 100*h*. The channel-shaped wing 123*h* is advantageously arranged in such a manner in the interruption 106*h* that the air channel 100*f* continues to be realized in a substantially closed manner. In particular, the wall of the air channel 100*h* is continued in the interruption 106*h* by the wing 123*h* of the cooling body unit 120*h*.

Figure 10A:
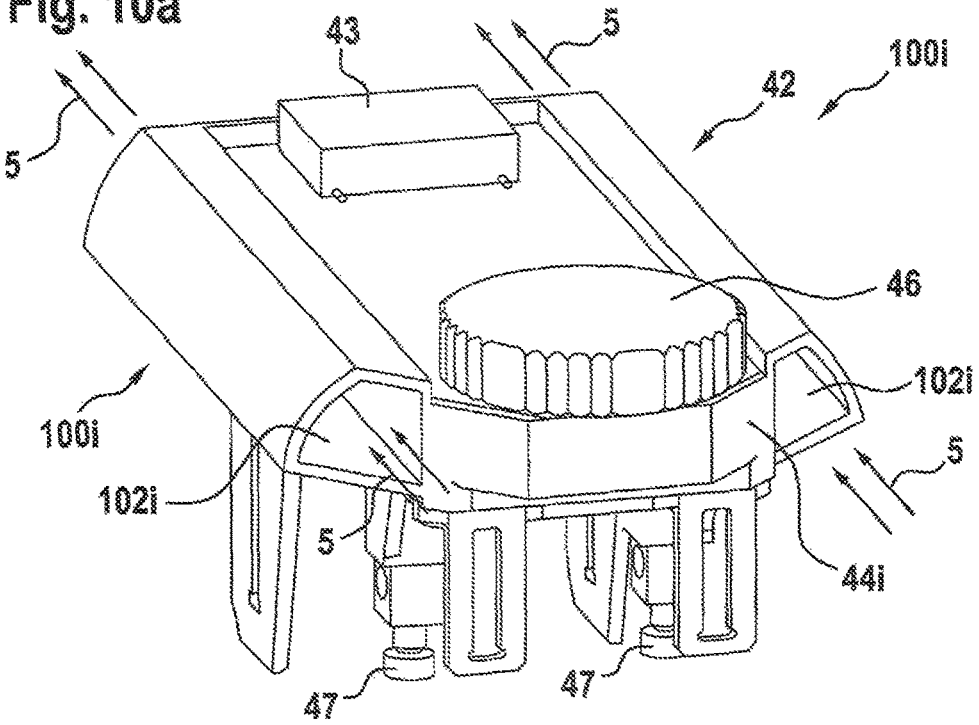
FIG. 10*a*: shows a perspective view of a carrier component with air channels.
Figure 10B:
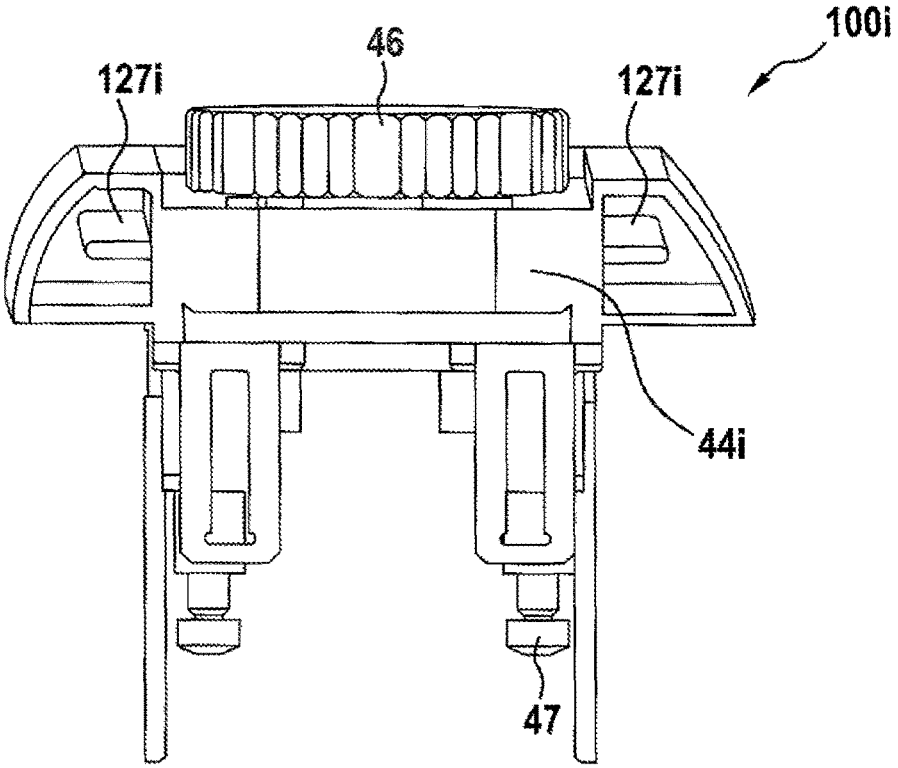
FIG. 10*b*: shows a perspective view of a carrier component with air channels.

In a further alternative embodiment, the air channels 100*i* can be realized integrally with the carrier component 44*i* (shown in FIG. 10*a* and FIG. 10*b*). The setting wheel 46, the mains connections 47 and an electronic element 43 are arranged, as an example, on the carrier component 44*i*. In an advantageous manner, cooling air is conducted to the air inlet openings 102*i* of the air channels 100*i* via air intake openings which are arranged on the end face of the housing of the hand-held power tool (not shown). In this case, the air intake openings can be arranged in a housing part such as, for example, the handle housing 40 or the socketed cover 50, or realized as air inlet openings 102*i* of the air channels 100*i*. The carrier component 44*i* is realized from an insulating material. An insulating material is to be understood, in particular, as a plastics material with a resistance of at least $10^{12}\Omega$. In an advantageous manner, the air channels 100*i*, in particular the carrier component 44*i*, are realized from a heat-conducting material. A heat-conducting material is to be understood, in this case, in particular, as a plastics material which comprises heat conductivity of at least 0.3 W/mK. In an advantageous manner, the electronics 42 can be cooled as a result of a heat-conducting carrier component 44*i* with integrally realized air channels 100*i* by means of the cooling air which flows through the air channels 100*i*, without the electronics 42 comprising a separate cooling body unit. To increase the performance of the cooling of the electronics 42, the air channels 100*i* can comprise ribs 127*i*. The ribs 127*i* are realized integrally with the carrier component 44*i* and extend along the longitudinal extension of the air channels 100*i*. The ribs 127*i* provide an additional top surface inside the air channels 100*i*, via which the waste heat of the electronics 42 is able to dissipate. It is conceivable to arrange further ribs 127*i* inside the air channel 100*i* in order to increase the performance of the cooling further.

What is claimed is:

1. A hand-held power tool, comprising:

a housing including a first housing part and an air intake opening;

a motor assigned to a drive train of the hand-held power tool and located in the housing;

a cooling unit located in the housing and configured to cool the motor; and at least one electronic located in the housing, wherein:

the first housing part includes at least one first air channel that is integral with the first housing part, the at least one first air channel including:

a first surrounding wall integral with the first housing part and extending in a longitudinal direction of the at least one first air channel;

a first air inlet opening; and a first air outlet opening;

the at least one first air channel is configured in a closed manner such that the at least one first air channel is circumferentially surrounded by the first surrounding wall between the first air inlet opening and the first air outlet opening; and the air intake opening is configured to conduct a cooling air flow directly to the motor via the at least one first air channel.

2. The hand-held power tool according to claim 1, wherein:

the housing includes at least one second housing part having at least one second air channel, the at least one second air channel including:

a second surrounding wall integral with the second housing part and extending in the longitudinal direction;

a second air inlet opening; and a second air outlet opening;

the at least one second air channel is configured in a closed manner such that the at least one second air channel is circumferentially surrounded by the second surrounding wall between the second air inlet opening and the second air outlet opening;

the first housing part further includes a third air channel; and the at least one first air channel, the at least one second air channel, and the third air channel are arranged in a circumferential direction of the housing.

3. The hand-held power tool according to claim 1, wherein the at least one first air channel of the first housing part and the at least one second air channel of the second housing part are arranged so as to provide an anti-rotation device of the first and second housing parts with respect to each other.

4. A hand-held power tool, comprising:

a housing including a first housing part and an air intake opening;

a motor assigned to a drive train of the hand-held power tool and located in the housing;

a cooling unit located in the housing and configured to cool the motor; and at least one electronic located in the housing, wherein:

the first housing part includes at least one first air channel that is integral with the first housing part;

the air intake opening is configured to conduct a cooling air flow directly to the motor via the at least one first air channel;

the housing includes at least one second housing part having at least one second air channel;

the first housing part further includes a third air channel;

the at least one first air channel, the at least one second air channel, and the third air channel are arranged in a circumferential direction of the housing; and at least one of the first housing part and the at least one second housing part is a socketed cover including at least one fourth air channel.

5. The hand-held power tool according to claim 1, wherein the air intake opening is located on at least one of an end-face end of the housing and a side of the housing.

6. A hand-held power tool, comprising:

a housing including a first housing part and an air intake opening;

a motor assigned to a drive train of the hand-held power tool and located in the housing;

a cooling unit located in the housing and configured to cool the motor; and at least one electronic located in the housing, wherein:

the first housing part includes at least one first air channel that is integral with the first housing part;

the air intake opening is configured to conduct a cooling air flow directly to the motor via the at least one first air channel;

the at least one first air channel includes a recess; and a cooling body of the at least one electronic is located in the recess, such that the cooling body forms at least a portion of at least one wall of the at least one first air channel.

7. A hand-held power tool, comprising:

a housing including a first housing part and an air intake opening;

a motor assigned to a drive train of the hand-held power tool and located in the housing;

a cooling unit located in the housing and configured to cool the motor; and at least one electronic located in the housing, wherein:

the first housing part includes at least one first air channel that is integral with the first housing part;

the air intake opening is configured to conduct a cooling air flow directly to the motor via the at least one first air channel; and at least a portion of a cooling body of the at least one electronic at least partially defines the at least one first air channel.

8. The hand-held power tool according to claim 4, wherein:

the at least one electronic is arranged on a carrier component; and the carrier component includes at least one fifth air channel.

9. The hand-held power tool according to claim 8, wherein the carrier component is a cooling body.

10. The hand-held power tool according to claim 1, wherein the hand-held power tool is an angle-grinding machine.

11. The hand-held power tool according to claim 1, wherein the housing is a motor housing.

12. The hand-held power tool according to claim 2, wherein the at least one second housing part is a handle housing.

13. A hand-held power tool, comprising:

a housing including a first housing part and an air intake opening;

a motor assigned to a drive train of the hand-held power tool and located in the housing;

a cooling unit located in the housing and configured to cool the motor; and at least one electronic located in the housing, wherein:

the first housing part includes at least one first air channel that is integral with the first housing part;

the air intake opening is configured to conduct a cooling air flow directly to the motor via the at least one first air channel;

the housing includes at least one second housing part having at least one second air channel;

the first housing part further includes a third air channel;

the at least one first air channel, the at least one second air channel, and the third air channel are arranged in a circumferential direction of the housing;

at least one of the first housing part and the at least one second housing part is a socketed cover including at least one fourth air channel;

the at least one electronic is arranged on a carrier component;

the carrier component includes at least one fifth air channel;

the carrier component is a cooling body; and the cooling body includes a heat-conducting material.

* * * * *